US007748581B2

(12) United States Patent
Yamada

(10) Patent No.: US 7,748,581 B2
(45) Date of Patent: Jul. 6, 2010

(54) THREE-DIMENSIONAL COLLAR SHAPE RETAINING HANGER

(75) Inventor: Osamu Yamada, Fukuoka (JP)

(73) Assignee: Maruso Industry Co., Ltd., Fukuoka-Ken (JP)

( * ) Notice: Subject to any disclaimer, the term of this patent is extended or adjusted under 35 U.S.C. 154(b) by 20 days.

(21) Appl. No.: 11/905,598

(22) Filed: Oct. 2, 2007

(65) Prior Publication Data

US 2008/0257919 A1 Oct. 23, 2008

(30) Foreign Application Priority Data

Jan. 16, 2007 (JP) ..... 2007-007450
Jun. 7, 2007 (JP) ..... 2007-151972

(51) Int. Cl.
*A41D 27/22* (2006.01)

(52) U.S. Cl. ..... 223/85; 223/92

(58) Field of Classification Search ..... 223/85, 223/87, 88, 92, 98
See application file for complete search history.

(56) References Cited

U.S. PATENT DOCUMENTS 2,147,590 A * 2/1939 Adkins ..... 223/98
2,171,301 A * 8/1939 Christensen et al. ..... 223/92
2,468,477 A * 4/1949 Zimmerman ..... 223/92
2,521,970 A * 9/1950 Duggan ..... 223/92
2,569,152 A * 9/1951 Collins ..... 223/92
2,582,633 A * 1/1952 Jacomini ..... 223/92
2,609,976 A * 9/1952 Burk et al. ..... 223/92
2,649,229 A * 8/1953 Sutter ..... 223/98
2,738,112 A * 3/1956 Miller ..... 223/85

(Continued)

FOREIGN PATENT DOCUMENTS

JP 3002647 7/1994

(Continued)

*Primary Examiner*—Gary L Welch
*Assistant Examiner*—Nathan E Durham
(74) *Attorney, Agent, or Firm*—Wenderoth, Lind & Ponack, L.L.P.

(57) ABSTRACT

A three-dimensional collar shape retaining hanger prevents collars of a plurality of garments from being crushed and is capable of being stacked in a large number. The hanger has a hook portion and a hanger body. Between the hook portion and the hanger body, a connecting plate part which is a central collar supporting portion body is provided to connect the hook portion and the hanger body. A pair of first curved parts which protrudes toward a rear side of the hanger so as to abut on a rear neck portion of a collar is connected to right and left sides of the connecting plate part. To end portions of the first curved parts, a pair of second curved parts is connected at each distal end thereof. Each base end of the second curved parts is connected to the hanger body. A portion between the distal end and the base end of each of the second curved parts protrudes toward the front side of the hanger so as to abut on an inside of a front portion of the collar. By this structure, a curve on a rear neck portion of a collar is supported by the first curved parts while a curve on a front portion of the collar is supported by the second curved parts, thereby retaining a whole curve of the collar. Therefore, when a large number of garments hung on the three-dimensional collar shape retaining hangers are stacked, the collars are not crushed.

17 Claims, 18 Drawing Sheets

U.S. PATENT DOCUMENTS

| | | | | | |
|---|---|---|---|---|---|
| 2,821,334 | A | * | 1/1958 | Koch | 223/98 |
| 2,861,726 | A | * | 11/1958 | Whyte | 223/92 |
| 2,880,928 | A | * | 4/1959 | Merrill | 223/98 |
| 2,973,887 | A | * | 3/1961 | Bonaldi | 223/88 |
| 3,045,881 | A | * | 7/1962 | Lilya | 223/92 |
| 3,531,027 | A | * | 9/1970 | Malmin | 223/88 |
| 5,360,148 | A | * | 11/1994 | Goscin et al. | 223/88 |
| 2006/0037981 | A1 | * | 2/2006 | Dedo | 223/87 |

FOREIGN PATENT DOCUMENTS

| | | |
|---|---|---|
| JP | 7-18674 | 4/1995 |
| JP | 8-10126 | 1/1996 |
| JP | 3065276 | 10/1999 |
| JP | 2000-51049 | 2/2000 |
| JP | 2000-93284 | 4/2000 |
| JP | 3074362 | 1/2001 |
| JP | 3085502 | 5/2002 |
| JP | 3549496 | 8/2004 |

* cited by examiner

THREE-DIMENSIONAL COLLAR SHAPE RETAINING HANGER

BACKGROUND OF THE INVENTION

1. Field of the Invention

The present invention relates to a garment hanger for shirts such as dress shirts which are packaged in a three-dimensional shape after washing and ironing in laundries.

2. Description of the Related Art

Conventionally, when a garment having a collar such as a dress shirt is hung on a hanger in a laundry after washing and ironing, a shape retaining member made of cardboard or the like is attached to the inside of the collar of the dress shirt or the like in order to prevent deformation of the collar portion of the garment.

However, attaching such a shape retaining member made of cardboard to the rear side of a collar of a dress shirt or the like is time-consuming and requires complicated work. Furthermore, when customers of laundries put cleaned clothes on, the shape retaining member is removed and thrown away as mere waste and is not reusable in laundry plants or shops, resulting in waste of resources.

In view of the foregoing, some garment hangers provided with collar crushing protective means have been devised as described in Japanese Utility Model Registration No. 3002647, Unexamined Japanese Patent Publication No. 2000-93284, Unexamined Japanese Patent Publication No. 2000-51049, Unexamined Japanese Patent Publication No. H8-10126, and Unexamined Japanese Utility Model Publication No. H7-18674, for example.

Japanese Utility Model Registration No. 3002647 discloses a garment hanger provided with a garment supporting portion and a hook portion connected to an upper center of the garment supporting portion. A deformation preventing tab is continuously formed on right and left ends of an upper portion of a supporting base of the garment supporting portion via a folding line. The deformation preventing tab is bent toward a front side of the garment supporting portion so as to abut on a base portion of a collar of a garment supported by the garment supporting portion.

Unexamined Japanese Patent Publication No. 2000-93284 discloses a hanger having a collar crushing protective means which protrudes forward to a clothing support part and can be deformed toward the clothing support part.

Unexamined Japanese Patent Publication No. 2000-51049 discloses a hanger with collar crush prevention pieces which are bendable at a plurality of hinge portions.

Unexamined Japanese Patent Publication No. H8-10126 discloses a three-dimensional garment clothing hanger composed of a hanging rod formed in a shape substantially conforming to the line of shoulders of a person and a collar mounting plate attached to the hanging rod. The collar mounting plate is formed in a shape which is approximately the same as the shape of a collar of such clothing as a shirt when a person wears the clothing.

Unexamined Japanese Utility Model Publication No. H7-18674 discloses a hanger having a neck with a guide portion for bending both sides of a shirt or the like provided on both ends of a shoulder portion. A collar retaining member is mounted on the neck of the hanger.

In the hangers disclosed in the above-described Japanese Utility Model Registration No. 3002647, Unexamined Japanese Patent Publication No. 2000-93284, and Unexamined Japanese Patent Publication No. 2000-51049, the portions for supporting clothing are flat, and the deformation-preventing tab or the collar crush prevention piece is formed so as to extend from these flat portions. Therefore, the deformation-preventing tab or the collar crush prevention piece abuts on the inside of a three-dimensionally curved collar of a shirt only by point contact and does not touch the collar so as to fit the curve of the collar.

Accordingly, when transporting shirts on hangers after cleaning, if a large number of shirts are hung without sufficient space between each garment, there is a problem that the collars are crushed.

In the hangers disclosed in Unexamined Japanese Patent Publication No. H8-10126 and Unexamined Japanese Utility Model Publication No. H7-18674, the collar mounting plate or the collar retaining member has to be separately manufactured and assembled to complete the whole product, which requires additional time and steps, resulting in cost increase. Moreover, since the collar mounting plate and the collar retaining member are bulky, there is a problem that compact stacking of a plurality of hangers is not possible.

In view of the above problems, some three-dimensional collar shape retaining hangers have been proposed as disclosed in Japanese Utility Model Registrations No. 3065276, No. 3085502 and No. 3074362 as well as Japanese Patent No. 3549496, for example. These hangers are capable of fitting a curved surface of a collar in order to retain the shape of the collar.

Japanese Utility Model Registration No. 3065276 discloses a hanger for three-dimensional packaging formed of a square mountain-shaped frame provided with a protruding portion widening toward the base thereof and a horizontally-long rectangular-shaped base body portion. A V-shaped collar supporting portion is provided extending from slanted bars on both sides of the protruding portion to the center of a bottom beam of the base body portion. A V-shaped inner side of the V-shaped collar supporting portion is formed so as to rise frontward at a steeper angle against the square mountain-shaped frame approaching the bottom beam side.

Japanese Utility Model Registration No. 3085502 discloses a hanger composed of a hanger body having a shoulder supporting portion for supporting a shoulder portion of a dress shirt or the like and a collar supporting portion connected to the center of a top end of the shoulder supporting portion for supporting a collar portion of a dress shirt, a hook portion connected to an upper side of the hanger body, and a pair of collar guides formed to extend from the collar supporting portion of the hanger body around the both sides of the collar supporting portion toward the approximate center of a bottom end of the shoulder supporting portion. Each of the collar guides has a curved portion which conforms to a curved surface inside the collar portion of the shirt.

Japanese Utility Model Registration No. 3074362 discloses a hanger composed of a hook portion, a neck portion and a body portion, which is also used as a pattern core plate for folding a garment. The neck portion is formed in a curved and bulged shape like a halved bowl, with a lower end thereof being separated from a side surface of the body portion.

Japanese Patent No. 3549496 discloses a three-dimensional collar shape keeping hanger formed with a collar shape keeping part between a hook part and a hanger main body. The collar shape keeping part has curved parts smoothly curved along each curve from a rear neck part toward sides of a collar on both sides of the collar shape keeping part in the longitudinal direction.

However, in the hangers described in the above-mentioned Japanese Utility Model Registrations No. 3065276, No. 3085502 and No. 3074362, although the front surface of the collar supporting portion (the neck portion) is curved along the curve of the front of a collar of a garment, the linearlyformed outer peripheral portion between the front and rear faces of the collar supporting portion may possibly bend the collar which abuts on the outer peripheral portion.

The collar shape keeping part in Japanese Patent No. 3549496 has curved parts smoothly curved along each curve from a rear neck part toward sides of a collar on both sides of the collar shape keeping part in the longitudinal direction. With this hanger, the shape of a collar is maintained from the rear up to the sides of a collar. However, if dress shirts are stacked and pressed, the front face of the collar might be crushed.

For example, in laundry plants or shops, a large number of garments such as dress shirts are hung on hangers and suspended from pipes after cleaning. When the garments, while being hung on hangers, are moved in the longitudinal direction of the pipes to make room or several hangers are grabbed by hand to remove them from the pipes, the stacked portions of the collars are pressed between the front and rear faces of the collar shape keeping parts, thereby crushing the front faces of the collars.

Accordingly, an object of the present invention is to provide a three-dimensional collar shape retaining hanger which can prevent a collar of a garment from being crushed when stacking a plurality of hangers with garments hung thereon. Furthermore, the hangers themselves can be stacked in a large number.

SUMMARY OF THE INVENTION

In order to solve the above-described problems, a three-dimensional collar shape retaining hanger according to a first structure of the present invention is a hanger having a hook portion, a hanger body and a curved collar supporting portion, the collar supporting portion comprising a rear collar supporting part which protrudes toward a rear side of the hanger so as to abut on an inside of a rear portion of a collar of a garment to be hung on the hanger body, a front collar supporting part which protrudes toward a front side of the hanger so as to abut on an inside of a front portion of the collar, and a pair of curved side collar supporting parts which abut on insides of side portions of the collar.

In the above first structure, a curve on a rear neck portion of a collar is supported by the rear collar supporting part of the collar supporting portion, a curve on a front portion of the collar is supported by the front collar supporting part, and side portions of the collar are supported by the curved side collar supporting parts. Thus, a whole curve of the collar can be supported. Therefore, when a large number of garments hung on the hangers are stacked, the collars are not crushed.

A three-dimensional collar shape retaining hanger according to a second structure of the present invention is a hanger of the first structure in which the curved collar supporting portion comprises a pair of first curved parts which protrudes toward a rear side of the hanger so as to abut on an inside of a rear portion of a collar, and a pair of second curved parts which has distal ends connected to end portions of the first curved parts and protrudes toward a front side of the hanger so as to abut on an inside of a front portion of the collar.

In the above second structure, a curve on a rear neck portion of a collar is supported by the first curved parts, and a curve on a front portion of the collar is supported by the second curved parts. Thus, a whole curve of the collar can be supported. Therefore, when a large number of garments hung on the hangers are stacked, the collars are not crushed.

A three-dimensional collar shape retaining hanger according to a third structure of the present invention is a hanger of the second structure in which the first curved parts and the second curved parts are formed at different positions in relation to a vertical or horizontal direction.

In the above third structure, since the positions of the first and second curved parts are different in relation to a vertical or horizontal direction, the hangers can be tightly stacked to minimize a necessary space when transporting and storing the hangers.

A three-dimensional collar shape retaining hanger according to a fourth structure of the present invention is a hanger of the first structure in which the curved collar supporting portion comprises a pair of first curved parts which protrudes toward a rear side of the hanger so as to abut on an inside of a rear portion of a collar, and a second curved part which is formed between the pair of first curved parts and protrudes toward a front side of the hanger.

The three-dimensional collar shape retaining hanger realized in the above fourth structure has the curved collar supporting portion composed of the first curved parts and the second curved part formed at different positions in relation to a horizontal direction.

A three-dimensional collar shape retaining hanger according to a fifth structure of the present invention is a hanger of the first structure in which the curved collar supporting portion comprises at least one first curved part which protrudes toward a rear side of the hanger so as to abut on an inside of a rear portion of a collar, and at least one second curved part which is formed at a height different from the first curved part and protrudes toward a front side of the hanger.

The three-dimensional collar shape retaining hanger realized in the above fifth structure has the curved collar supporting portion composed of the first curved part and the second curved part formed at different positions in relation to a vertical direction.

A three-dimensional collar shape retaining hanger according to a sixth structure of the present invention is a hanger of the first structure in which the curved collar supporting portion comprises a third curved part of which central portion protrudes toward a rear side of the hanger so as to abut on an inside of a rear portion of a collar, and a pair of fourth curved parts which protrudes toward a front side of the hanger so as to abut on an inside of a front portion of the collar.

In the above sixth structure, a curve on a rear neck portion of a collar is supported by the protruding portion at the central portion of the third curved part, and a curve on a front portion of the collar is supported by the protruding portions on both sides of the pair of fourth curved parts. Thus, a whole curve of the collar can be supported. Therefore, when a large number of garments hung on the hangers are stacked, the collars are not crushed. Since the third curved part, in particular, has the central portion protruding toward the rear side of the hanger, when a large number of garments hung on the three-dimensional collar shape retaining hangers are stacked, a rear portion of each collar of the garments is not crushed by another garment positioned on the rear side thereof, retaining a shape of a curve of the rear portion of the collar.

According to the present invention, in a hanger having a hook portion, a hanger body and a curved collar supporting portion, the collar supporting portion comprises a rear collar supporting part which protrudes toward a rear side of the hanger so as to abut on an inside of a rear portion of a collar of a garment to be hung on the hanger body, a front collar supporting part which protrudes toward a front side of the hanger so as to abut on an inside of a front portion of the collar, and a pair of curved side collar supporting parts which abut on insides of side portions of the collar. By this structure, a collar of a garment is prevented from being crushed when stacking a plurality of hangers with garments hung thereon.

Furthermore, the hanger itself is formed to have a shape which can be stacked in a large number, thereby minimizing a space necessary for housing and storing the hangers.

In addition, since the hanger of the present invention can be integrally formed by molding synthetic resin, the cost required for molding can be reduced. Moreover, it is not necessary to assemble a plurality of members, resulting in further cost saving.

DETAILED DESCRIPTION OF THE PREFERRED EMBODIMENT

Figure 1:
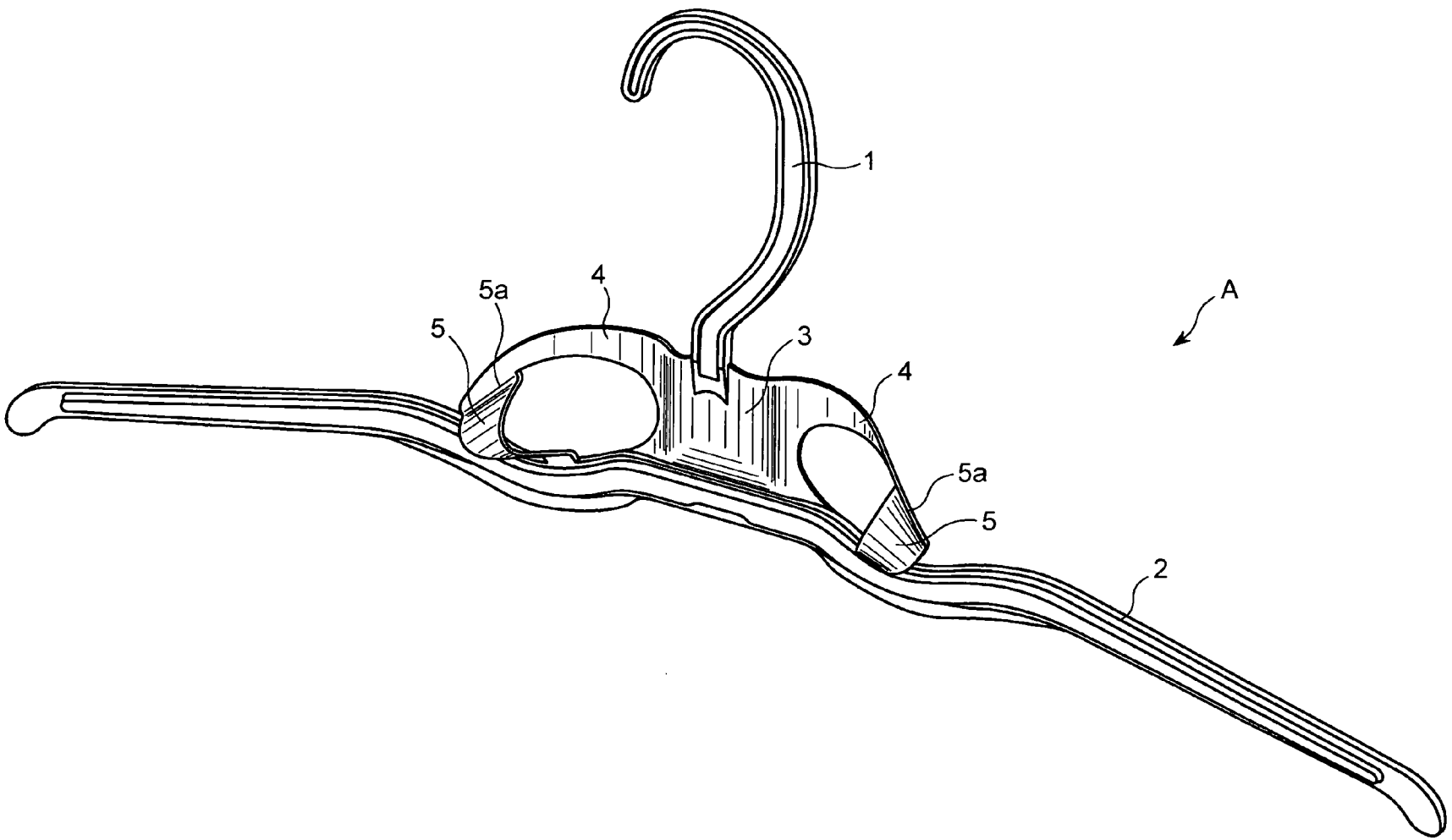
FIG. 1 is a perspective view illustrating a three-dimensional collar shape retaining hanger A according to a first embodiment of the present invention.
Figure 2:
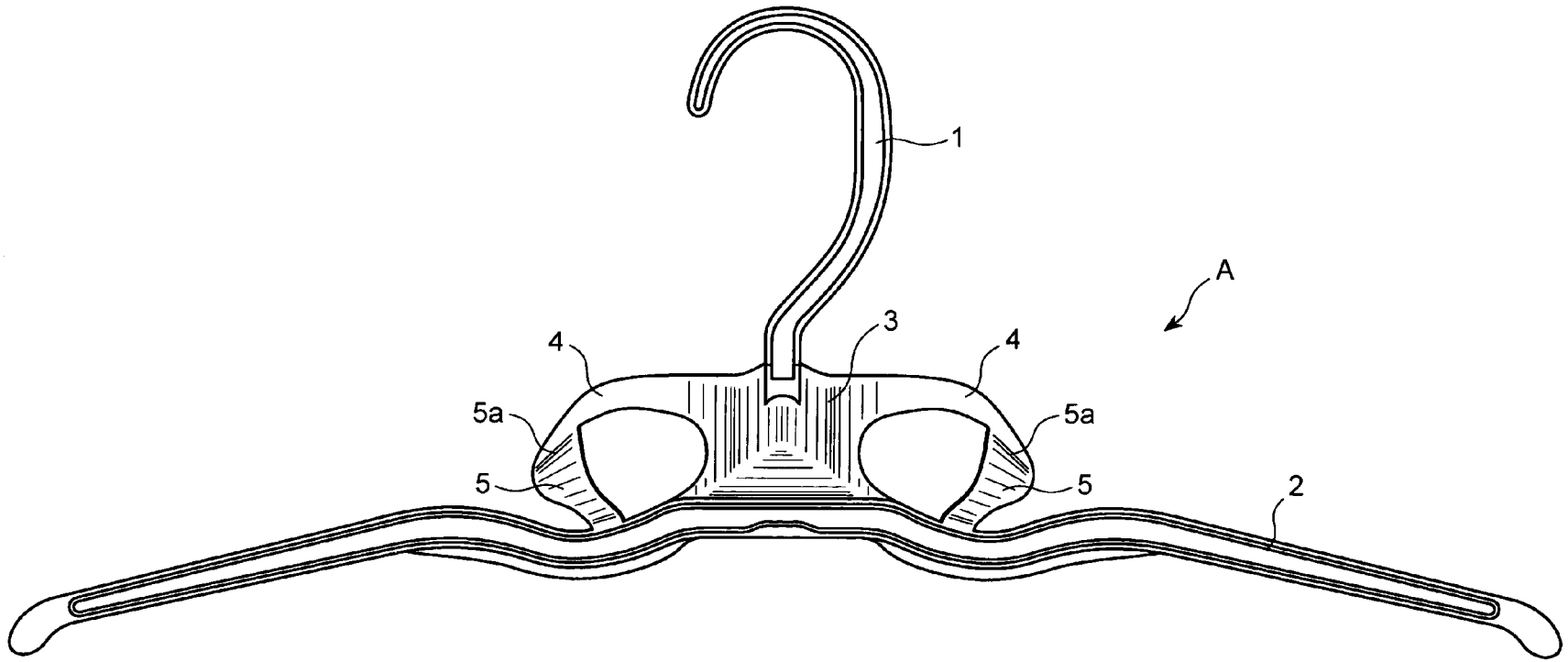
FIG. 2 is a front view illustrating the three-dimensional collar shape retaining hanger A according to the first embodiment of the present invention.
Figure 3:
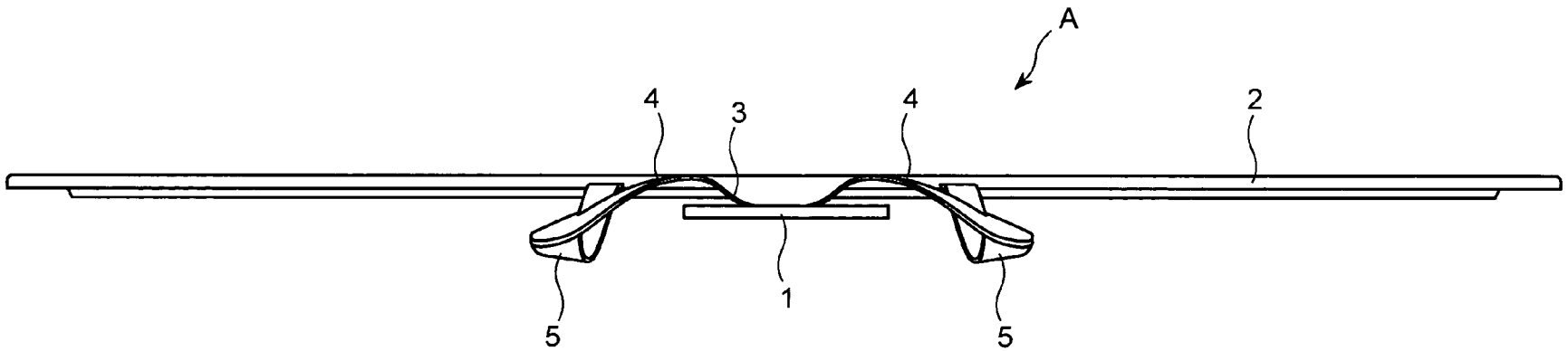
FIG. 3 is a plan view illustrating the three-dimensional collar shape retaining hanger A according to the first embodiment of the present invention.
Figure 4:
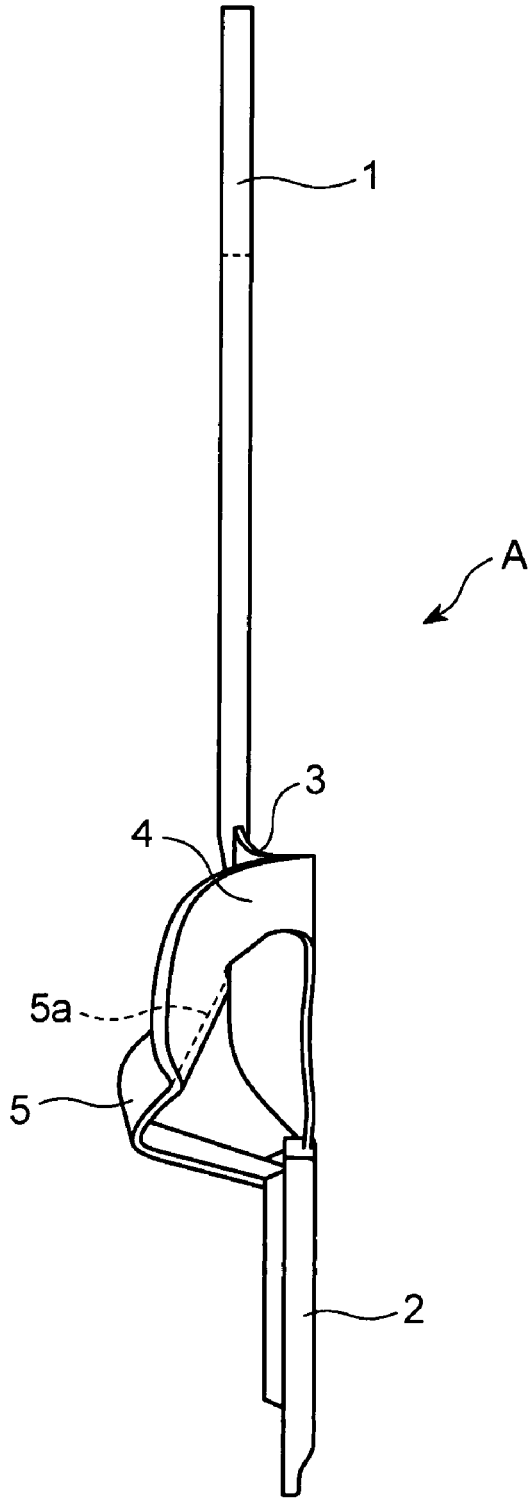
FIG. 4 is a side view illustrating the three-dimensional collar shape retaining hanger A according to the first embodiment of the present invention.
Figure 5:
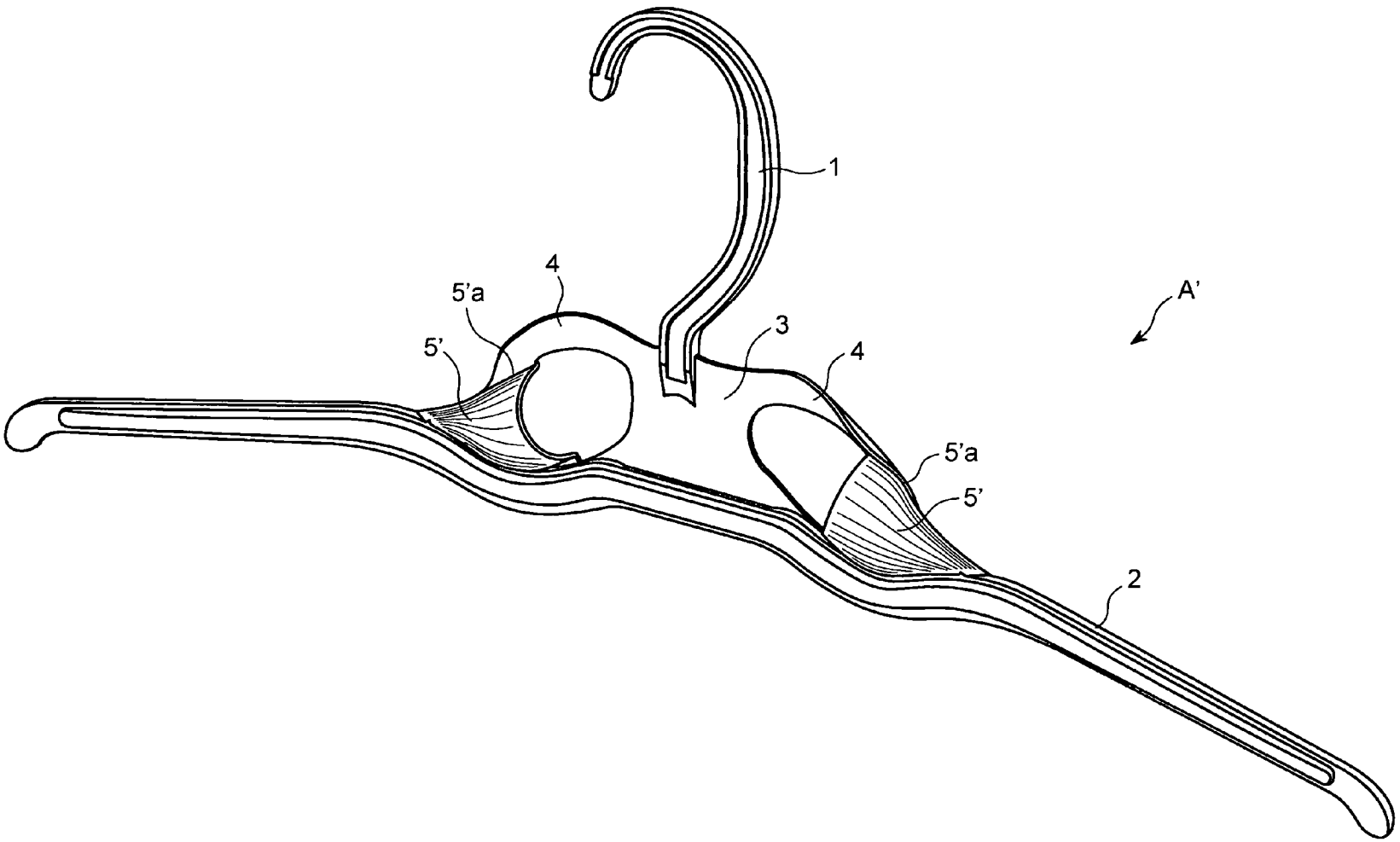
FIG. 5 is a perspective view illustrating a three-dimensional collar shape retaining hanger A' according to a second embodiment of the present invention.
Figure 6:
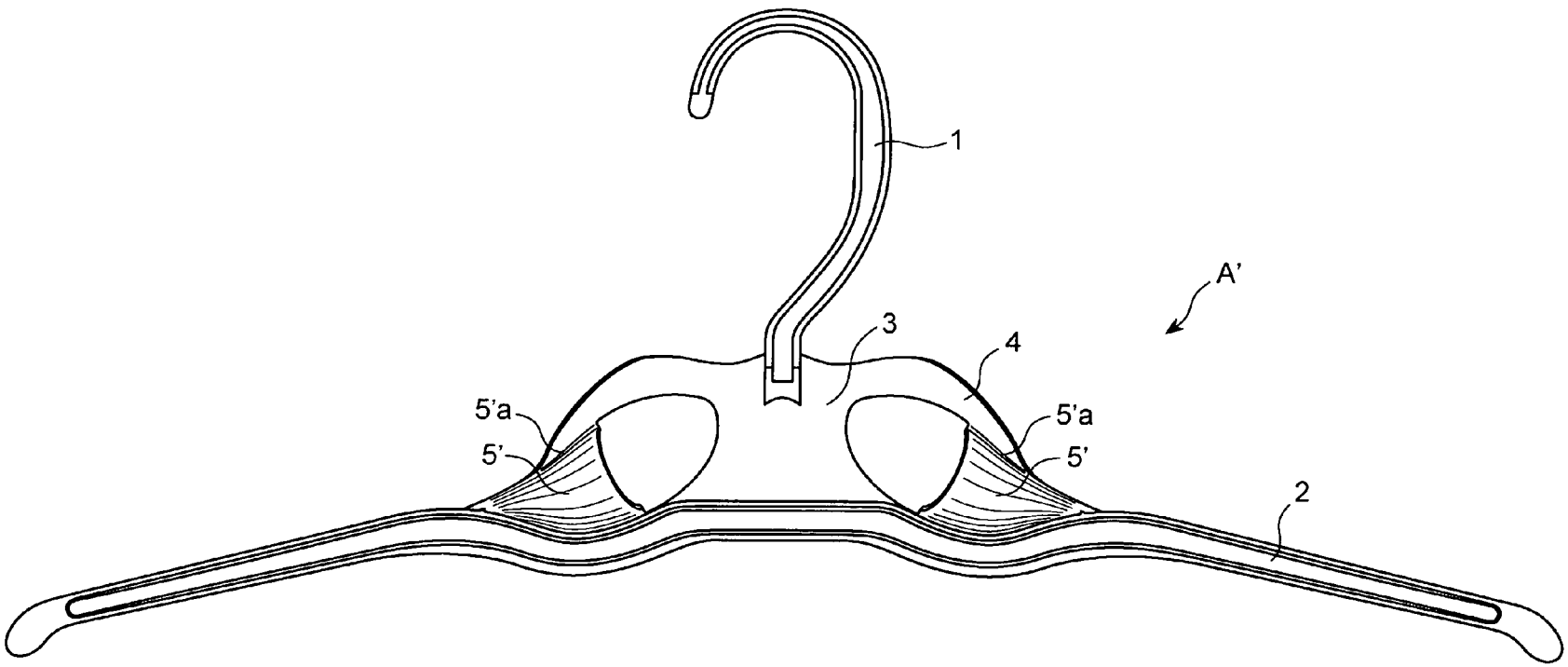
FIG. 6 is a front view illustrating the three-dimensional collar shape retaining hanger A' according to the second embodiment of the present invention.
Figure 7:
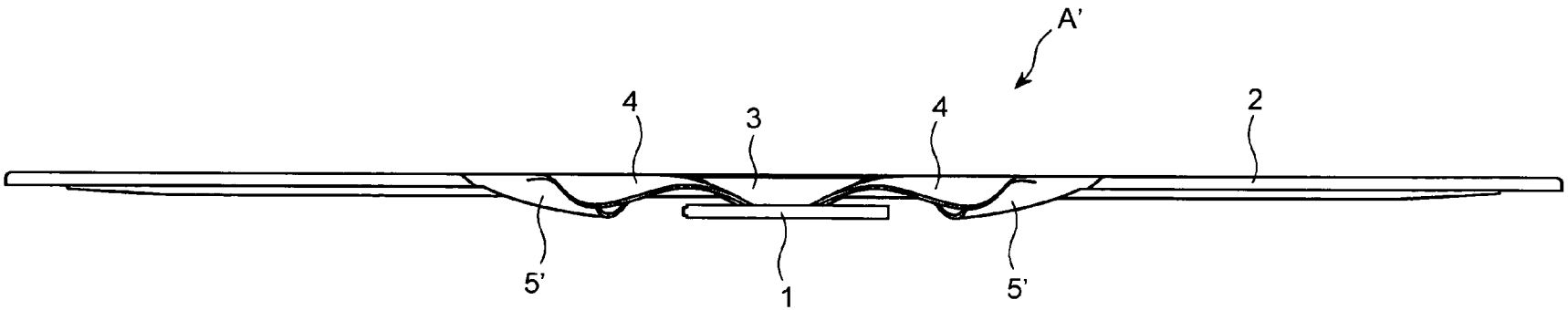
FIG. 7 is a plan view illustrating the three-dimensional collar shape retaining hanger A' according to the second embodiment of the present invention.
Figure 8:
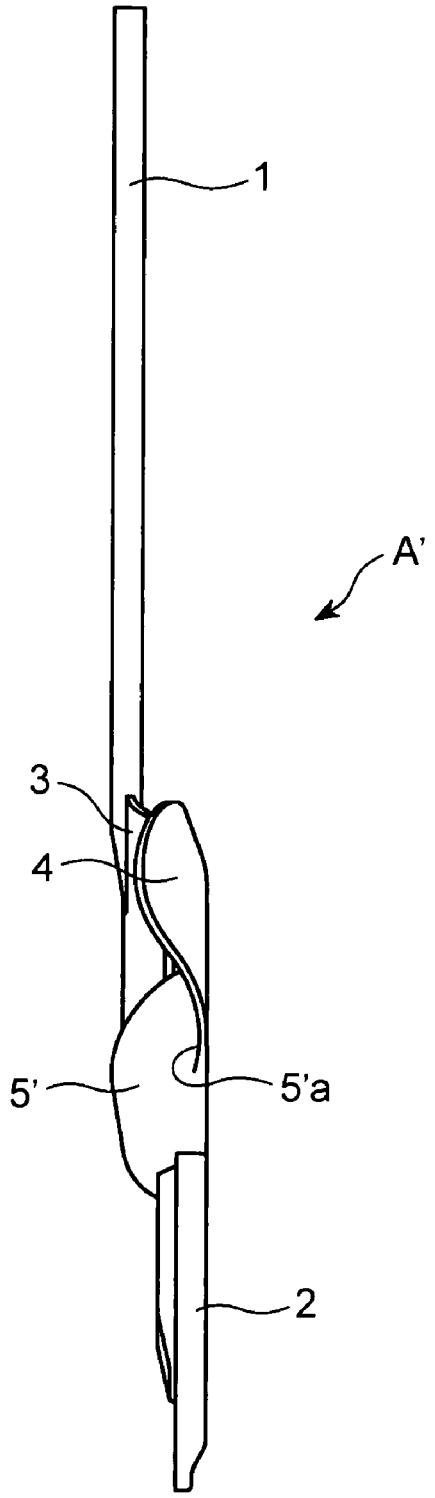
FIG. 8 is a side view illustrating the three-dimensional collar shape retaining hanger A' according to the second embodiment of the present invention.

Embodiments of the present invention are described below.

Embodiment 1

A first embodiment of the present invention is explained below with reference to FIGS. 1 to 4.

The first embodiment is a hanger for suspending a garment by hanging a shoulder portion of a dress shirt or the like over the hanger.

In FIGS. 1 to 4, a three-dimensional collar shape retaining hanger A of the first embodiment has a hook portion 1 and a hanger body 2. Between the hook portion 1 and the hanger body 2, a connecting plate part 3 (i.e. a connecting plate portion) which is a central collar supporting portion body is provided to connect the hook portion 1 and the hanger body 2. A pair of first curved parts 4 which protrudes toward a rear side of the hanger A so as to abut on a rear neck portion of a collar is connected to right and left sides of the connecting plate part 3, respectively (i.e. a first curved part formed at the connecting plate portion). To end portions of the first curved parts 4, a pair of second curved parts 5 is connected at each distal end thereof. Each base end of the second curved parts 5 is connected to the hanger body 2. The second curved parts 5 (i.e. a second curved part having an upper portion connected to a right distal end of the first curved part, and a third curved part having an upper portion connected to a left distal end of the first curved part) protrude toward a front side of the hanger A so as to abut on an inside of a front portion of a collar. The connecting plate part 3 is curved so as to protrude toward the front side of the hanger A. A whole body of the three-dimensional collar shape retaining hanger A is integrally molded by thermoplastic resin such as polypropylene or the like.

As described above, a center of a curvature of the first curved part 4 is on the front side, and a center of a curvature of the second curved part 5 is on the rear side. A connecting portion between the first curved part 4 and the second curved part 5, which is a threshold between the two centers of the curvatures, resides on each side.

By the above structure, a curve on a rear neck portion of a collar is supported by the first curved parts 4 while a curve on a front portion of the collar is supported by the second curved parts 5, thereby retaining a whole curve of the collar. Therefore, when a large number of garments hung on the three-dimensional collar shape retaining hangers A are stacked, the collars are not crushed.

As illustrated in the drawings, the pair of first curved parts 4 and the pair of second curved parts 5 are formed at different positions in relation to a vertical direction. A distal end 5*a* of each of the second curved parts 5 is connected to a distal end of the first curved part 4 at an inner side thereof in its lateral direction. By this structure, the three-dimensional collar shape retaining hanger A can be integrally formed by molding synthetic resin and can be stacked in a large number. Additionally, since a shape on the front side of the hanger A conforms to a shape on the rear side of the hanger A, the stacked hangers are not displaced, thereby preventing collapse of the cargo upon transportation.

Embodiment 2

A second embodiment of the present invention is explained below with reference to FIGS. 5 to 8.

The second embodiment is, as in the first embodiment, a hanger for suspending a garment by hanging a shoulder portion of a dress shirt or the like over the hanger.

In FIGS. 5 to 8, a three-dimensional collar shape retaining hanger A' of the second embodiment differs from the three-dimensional collar shape retaining hanger A of the first embodiment in that the three-dimensional collar shape retaining hanger A' is provided with a pair of second curved parts 5' having a halved conical shape instead of the belt-like second curved parts 5 of the first embodiment. A part of an upper side of each of the second curved parts 5' (i.e. a second curved part having an upper portion connected to a right distal end of the first curved part, and a third curved part having an upper portion connected to a left distal end of the first curved part) is connected to the end portion of each of the pair of the first curved parts 4 (i.e. a first curved part formed at the connection plate portion), and a lower side of each of the second curved parts 5' is wholly connected to the hanger body 2. A portion between upper and lower portions protrudes toward a front side of the hanger A' so as to abut on an inside of a front portion of a collar. As the remaining structures are identical with the first embodiment, the explanation is omitted by assigning the same reference numerals.

As described above, a center of a curvature of the first curved part 4 is on the front side, and a center of a curvature of the second curved part 5' is on the rear side. A connecting portion 5'*a* between the first curved part 4 and the second curved part 5', which is a threshold between the two centers of the curvatures, resides on each side.

By the above structure, a curve on a rear neck portion of a collar is supported by the first curved parts 4 while a curve on a front portion of the collar is supported by the second curved parts 5', thereby retaining a whole curve of the collar. Therefore, when a large number of garments hung on the three-dimensional collar shape retaining hangers A' are stacked, the collars are not crushed.

As illustrated in the drawings, the pair of first curved parts 4 and the pair of second curved parts 5' are formed at different positions in relation to a vertical direction. The connecting portion 5'*a* between the second curved part 5' and the first curved part 4 is connected to a distal end of the first curved part 4 at an inner side thereof in its lateral direction. By this structure, the three-dimensional collar shape retaining hanger A' can be integrally formed by molding synthetic resin and can be stacked in a large number. Additionally, since a shape on the front side of the hanger A' conforms to a shape on the rear side of the hanger A', the stacked hangers are not displaced, thereby preventing collapse of the cargo upon transportation.

Embodiment 3

A third embodiment of the present invention is explained below with reference to FIGS. 9A to 9C.

Figure 9A:
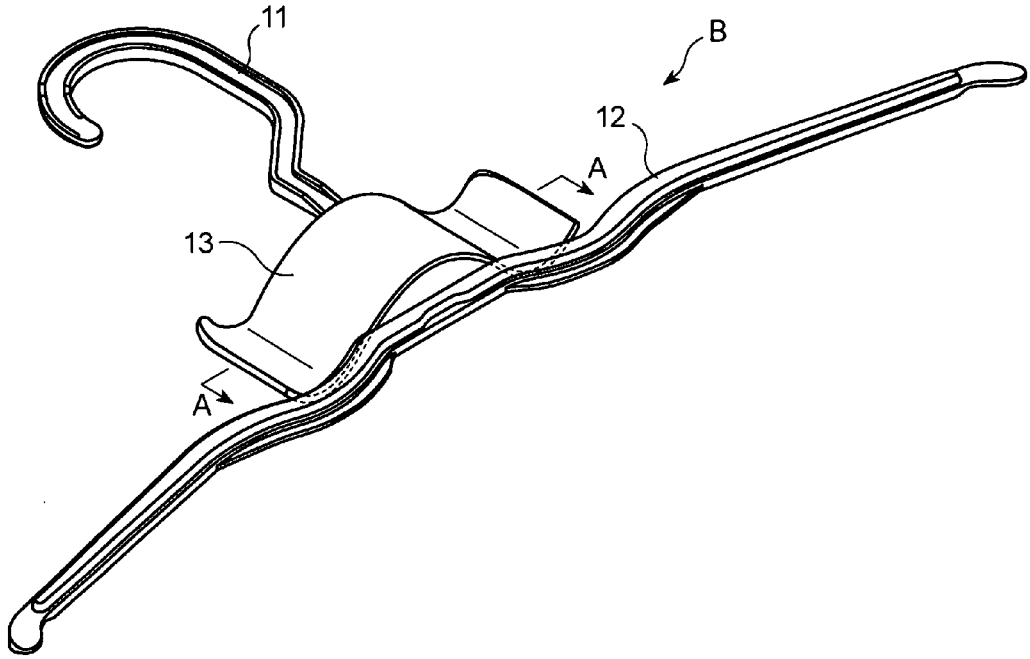
FIG. 9A is a perspective view illustrating a three-dimensional collar shape retaining hanger B according to a third embodiment of the present invention.
Figure 9B:
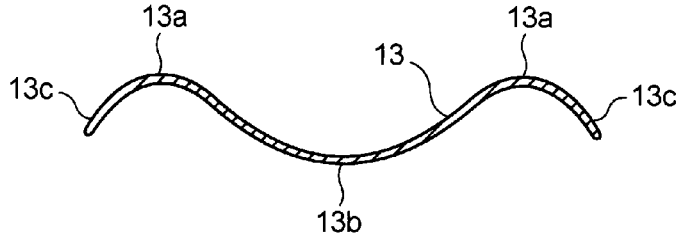
FIG. 9B is a sectional view taken along the line A-A of the FIG. 9A.
Figure 9C:
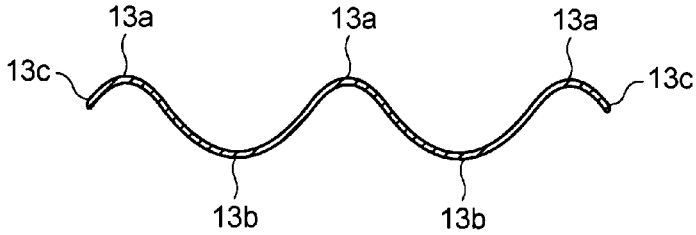
FIG. 9C is a sectional view illustrating another example.

As illustrated in FIG. 9A, a three-dimensional collar shape retaining hanger B according to the second embodiment of the present invention has a hook portion 11 and a hanger body 12. A connecting plate part 13 which is a central collar supporting portion body is provided to connect the hook portion 11 and the hanger body 12. A pair of first curved parts 13*a* which protrudes toward a rear side of the hanger B so as to abut on a rear neck portion of a collar is connected to right and left sides of the connecting plate part 13. To each end of the first curved parts 13*a*, a side curved part 13*c* is provided. At a center of the hanger B, a second curved part 13*b* which protrudes toward a front side of the hanger B so as to abut on an inside of a front portion of a collar is provided. As illustrated in FIG. 9C, the second curved part 13*b* which protrudes frontward can be formed at two positions. In this case, a central portion between the second curved parts 13*b* provided at two positions forms a third first curved part which protrudes rearward.

In this third embodiment, the connecting plate part 13 made of a single plate is curved to form the first curved part, the second curved part, and the side curved part so that curves on front and rear portions of a collar as well as curves on side portions of the collar are supported. Thus, when a large number of the hangers B with garments are stacked, the collars are not crushed, and a number of the hangers B can be layered upon storage.

Embodiment 4

A fourth embodiment of the present invention is explained below with reference to FIGS. 10A and 10B.

Figure 10A:
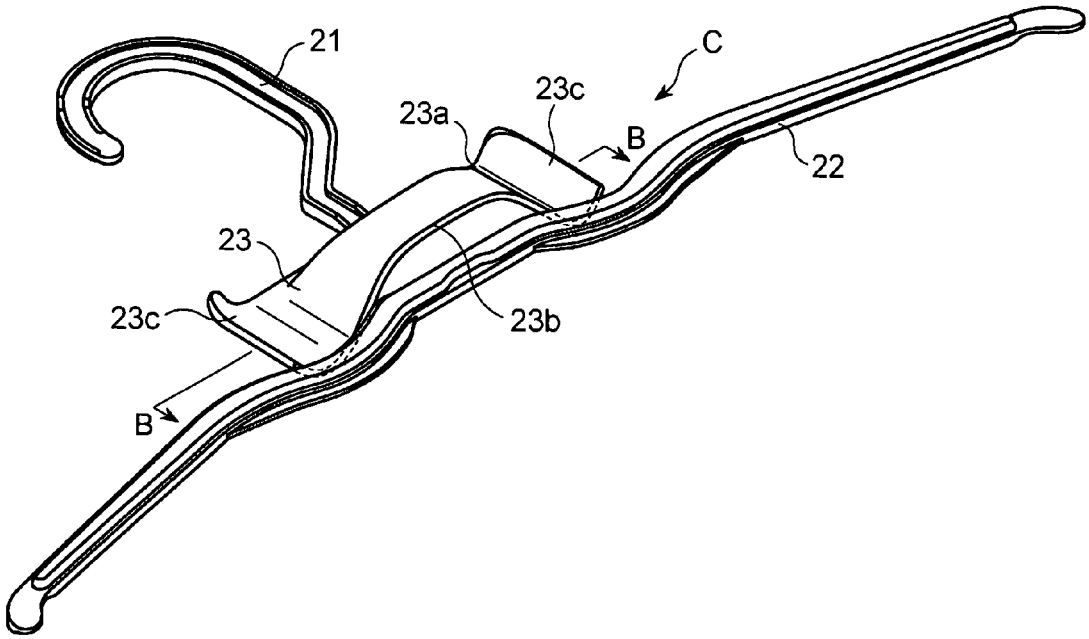
FIG. 10A is a perspective view illustrating a three-dimensional collar shape retaining hanger C according to a fourth embodiment of the present invention.
Figure 10B:
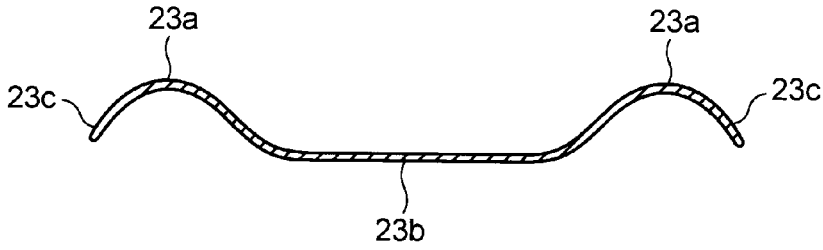
FIG. 10B is a sectional view taken along the line B-B of the FIG. 10A.

As illustrated in FIG. 10A, a three-dimensional collar shape retaining hanger C according to the fourth embodiment of the present invention has a hook portion 21 and a hanger body 22. A connecting plate part 23 which is a central collar supporting portion body is provided to connect the hook portion 21 and the hanger body 22. A pair of first curved parts 23*a* which protrudes toward a rear side of the hanger C so as to abut on a rear neck portion of a collar is connected to an upper end of the connecting plate part 23. To each end of the first curved parts 23, a side curved part 23*c* is provided. On a lower end of the connecting plate part 23, a second curved part 23*b* which protrudes toward a front side of the hanger C so as to abut on an inside of a front portion of a collar is provided.

In this fourth embodiment, the connecting plate part 23 made of a single plate is formed to have the first curved parts 23*a* and the second curved part 23*b* at different positions in relation to a vertical direction so that curves on front and rear portions of a collar as well as curves on side portions of the collar are supported. Thus, when a large number of the hangers C with garments are stacked, the collars are not crushed, and a number of the hangers C can be layered upon storage.

Embodiment 5

A fifth embodiment of the present invention is explained below with reference to FIGS. 11A and 11B.

Figure 11A:
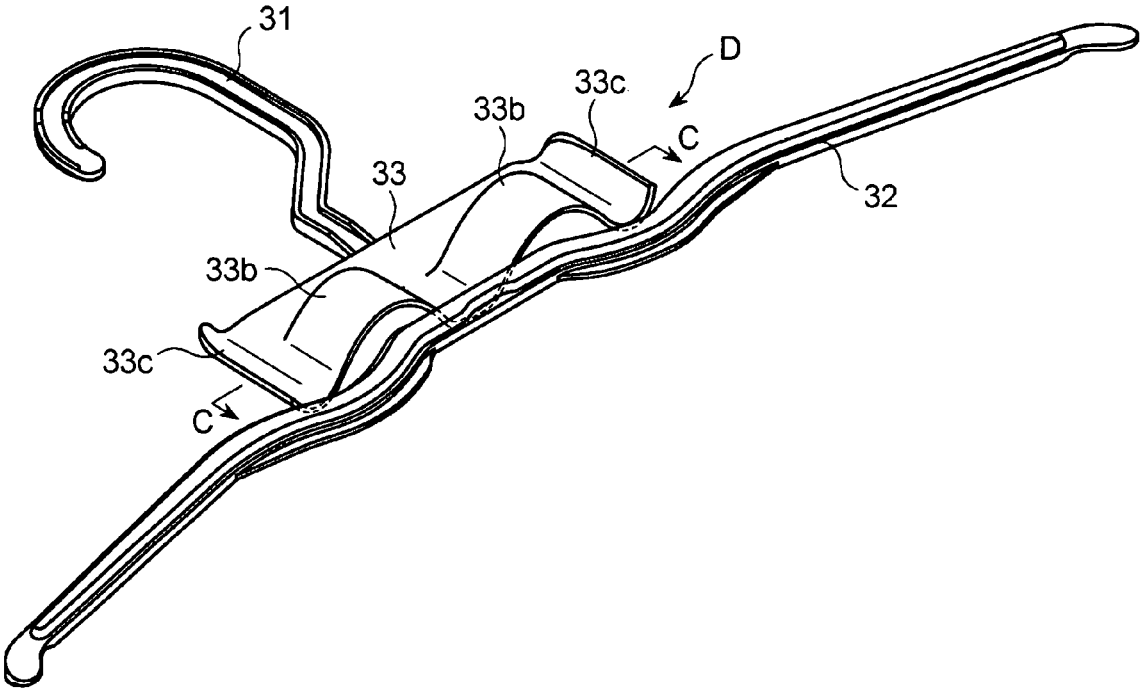
FIG. 11A is a perspective view illustrating a three-dimensional collar shape retaining hanger D according to a firth embodiment of the present invention.
Figure 11B:
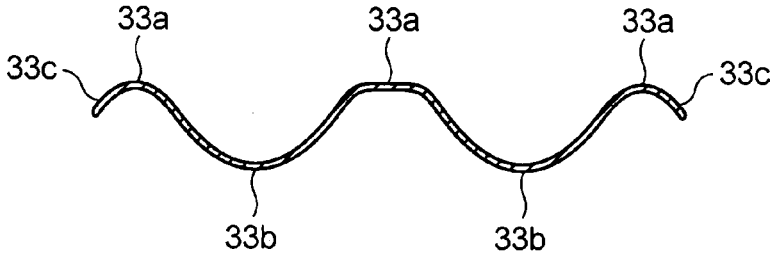
FIG. 11B is a sectional view taken along the line C-C of the FIG. 11A.
Figure 12:
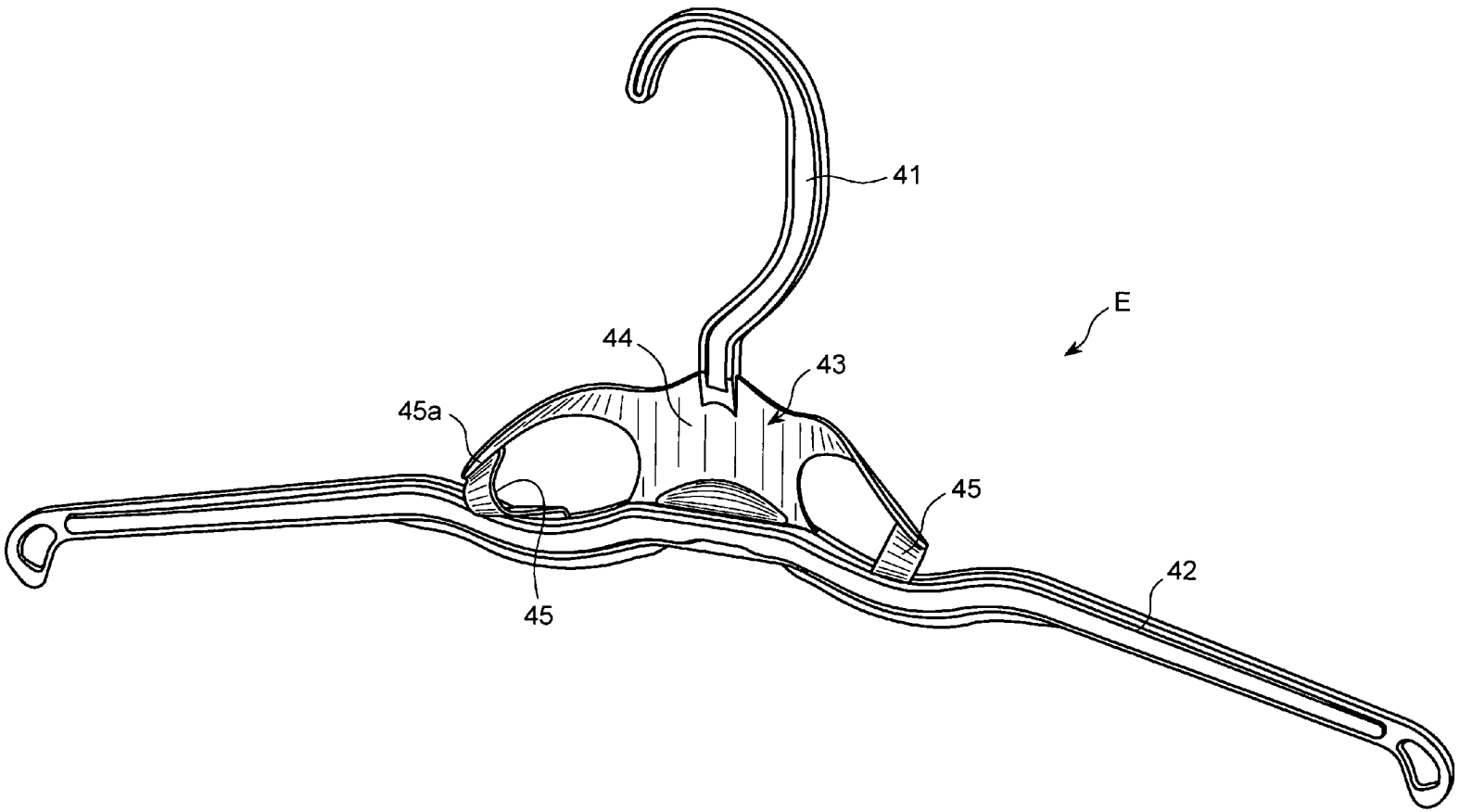
FIG. 12 is a perspective view illustrating a three-dimensional collar shape retaining hanger E according to a sixth embodiment of the present invention.
Figure 13:
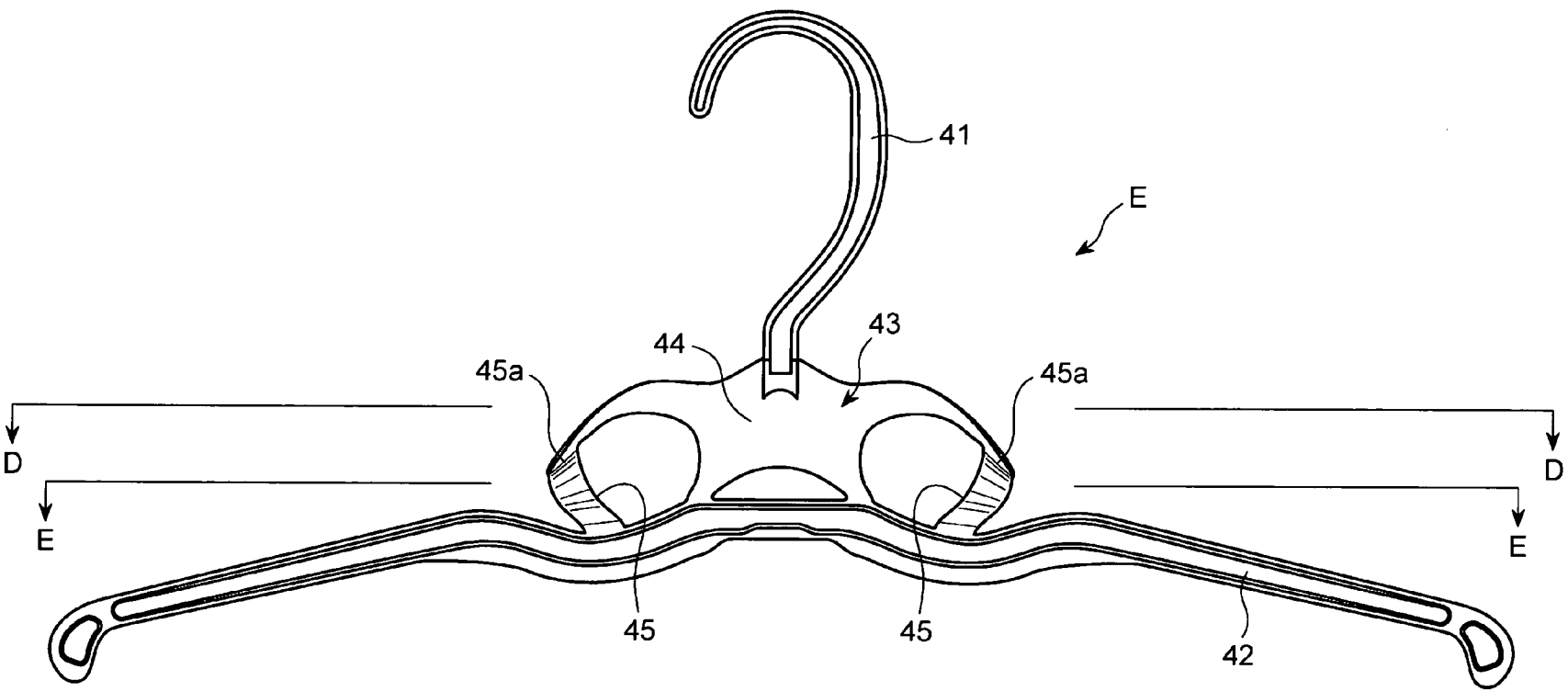
FIG. 13 is a front view illustrating the three-dimensional collar shape retaining hanger E according to the sixth embodiment of the present invention.
Figure 14:
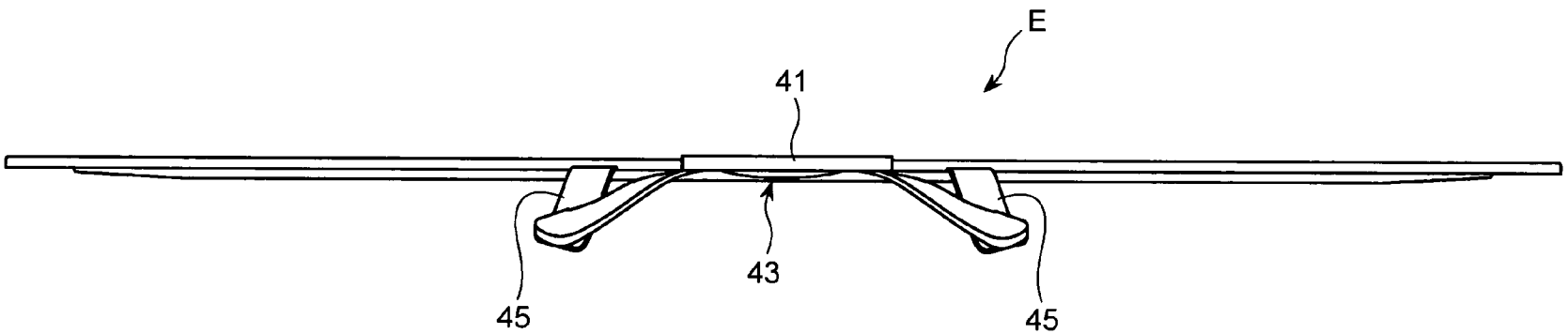
FIG. 14 is a plan view illustrating the three-dimensional collar shape retaining hanger E according to the sixth embodiment of the present invention.
Figure 15:
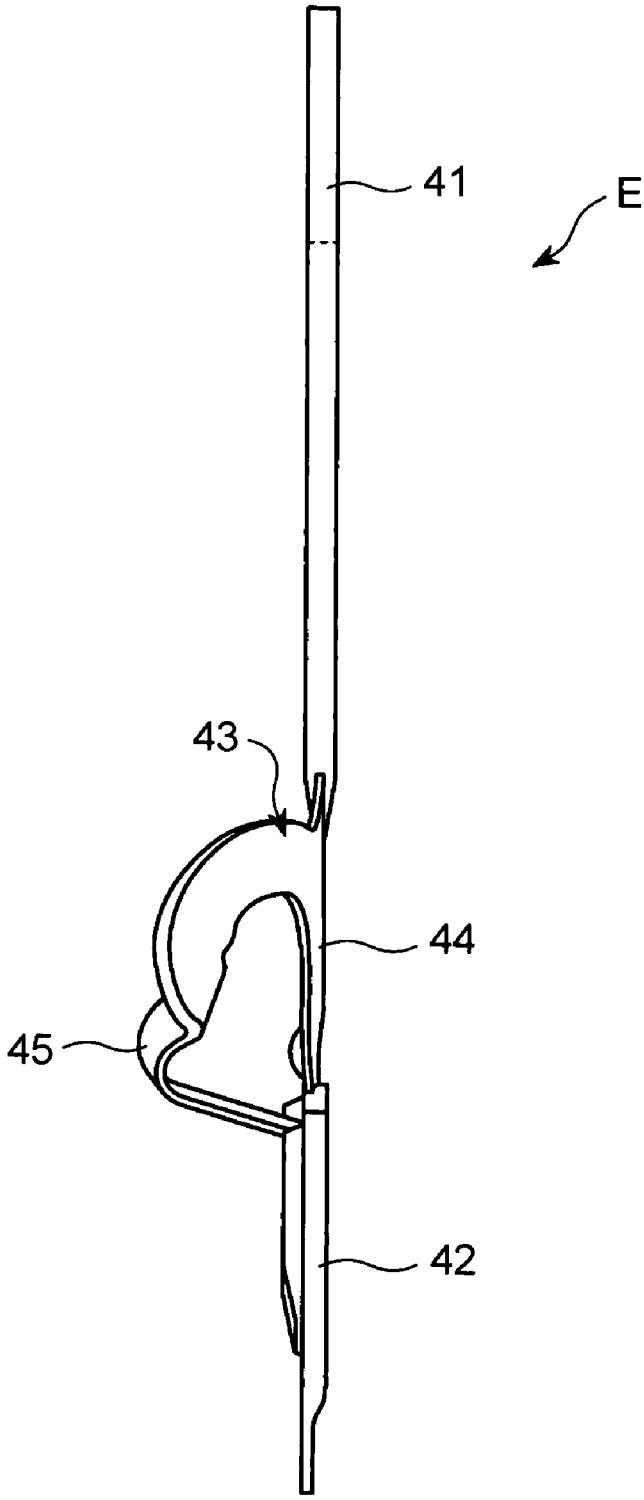
FIG. 15 is a side view illustrating the three-dimensional collar shape retaining hanger E according to the sixth embodiment of the present invention.
Figure 16:
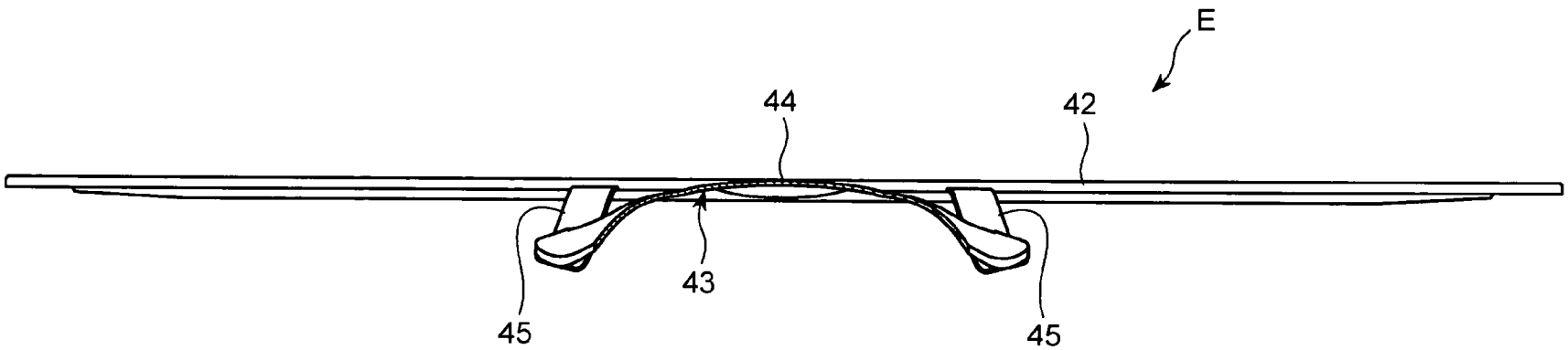
FIG. 16 is a sectional view taken along the line D-D of FIG. 13.
Figure 17:
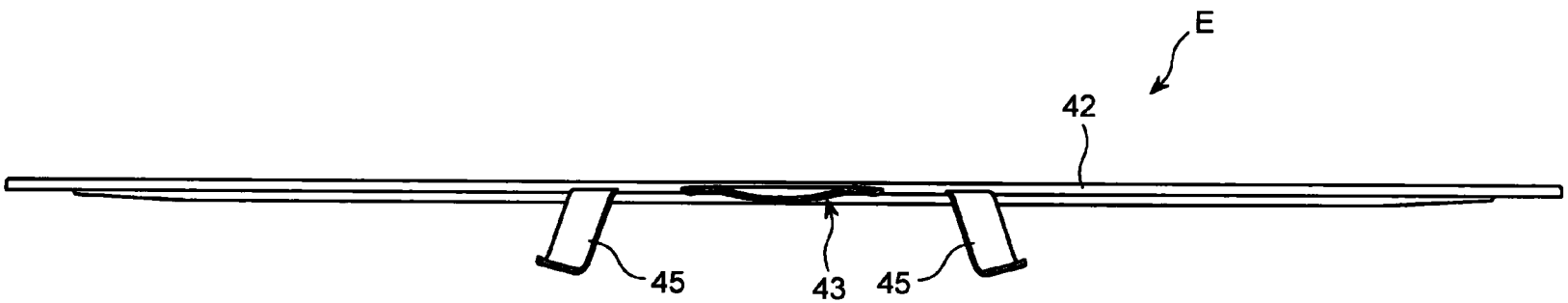
FIG. 17 is a sectional view taken along the line E-E of FIG. 13.

As illustrated in FIG. 11A, a three-dimensional collar shape retaining hanger D according to the fifth embodiment of the present invention has a hook portion 31 and a hanger body 32. A connecting plate part 33 which is a central collar supporting portion body is provided to connect the hook portion 31 and the hanger body 32. First curved parts 33*a* which protrude toward a rear side of the hanger D so as to abut on a rear neck portion of a collar are connected to an upper end of the connecting plate part 33. To each end of right and left sides of the connecting plate part 33, a side curved part 33*c* is provided. On an lower end of the connecting plate part 33, a pair of second curved parts 33*b* which protrudes toward a front side of the hanger D so as to abut on an inside of a front portion of a collar is provided. Between the pair of second curved parts 33*b*, a third first curved part 33*a* is formed to protrude rearward.

In this fifth embodiment, as in the fourth embodiment, the connecting plate part 33 made of a single plate is formed to have the first curved parts 33*a* and the second curved parts 33*b* at different positions in relation to a vertical direction so that curves on front and rear portions of a collar as well as curves on side portions of the collar are supported. Thus, when a large number of the hangers D with garments are stacked, the collars are not crushed, and a number of the hangers D can be layered upon storage.

Embodiment 6

A sixth embodiment of the present invention is explained below with reference to FIGS. 12 to 17.

In FIGS. 12 to 17, a three-dimensional collar shape retaining hanger E according to the sixth embodiment of the present invention has a hook portion 41 and a hanger body 42. A connecting plate part 43 (i.e. a connecting plate portion) which is a central collar supporting portion body is provided to connect the hook portion 41 and the hanger body 42. A third curved part 44 (i.e. a first curved part formed at the connecting plate portion) which protrudes toward a rear side of the hanger E so as to abut on a rear neck portion of a collar is formed at a central portion of the connecting plate part 43. To end portions of the connecting plate part 43, a pair of fourth curved parts 45 (i.e. a second curved part having an upper portion connected to a right distal end of the first curved part, and a third curved part having an upper portion connected to a left distal end of the first curved part) are connected at each distal end thereof. Each base end of the fourth curved parts 45 are connected to the hanger body 42. A portion between the distal end and the base end of each of the fourth curved parts 45 protrudes toward a front side of the hanger E so as to abut on an inside of a front portion of a collar. A whole body of the three-dimensional collar shape retaining hanger E is integrally molded by thermoplastic resin such as polypropylene of the like.

As described above, a center of a curvature of the third curved part 44 is on the front side, and a center of a curvature of each of the fourth curved parts 45 is on the rear side. Each connecting portion between the third curved part 44 and the fourth curved parts 45, which is a threshold between the two centers of the curvatures, resides on each side.

By the above structure, a curve on a rear neck portion of a collar is supported by the protruding portion at the center of the third curved part 44 while a curve on a front portion of the collar is supported by the protruding portions of the fourth curved parts 45 on both sides of the hanger E, thereby retaining a whole curve of the collar. Therefore, when a large number of garments hung on the three-dimensional collar shape retaining hangers E are stacked, the collars are not crushed. Since the third curved part 44, in particular, has the central portion protruding toward the rear side of the hanger E, when a large number of garments hung on the three-dimensional collar shape retaining hangers E are stacked, a rear portion of each collar of the garments is not crushed by another garment positioned on the rear side thereof, retaining a shape of a curve on the rear portion of the collar. Additionally, since a shape on the front side of the hanger E conforms to a shape of the rear side of the hanger E, the stacked hangers are not displaced, thereby preventing collapse of the cargo upon transportation.

Embodiment 7

A seventh embodiment of the present invention is explained below with reference to FIG. 18.

The seventh embodiment is a three-dimensional collar shape retaining hanger also used as a pattern core plate when delivering a dress shirt or the like after cleaning. Both shoulder portions and a lower portion of a dress shirt or the like are folded inwardly with the pattern core plate therein and packaged in a rectangular bag.

Figure 18:
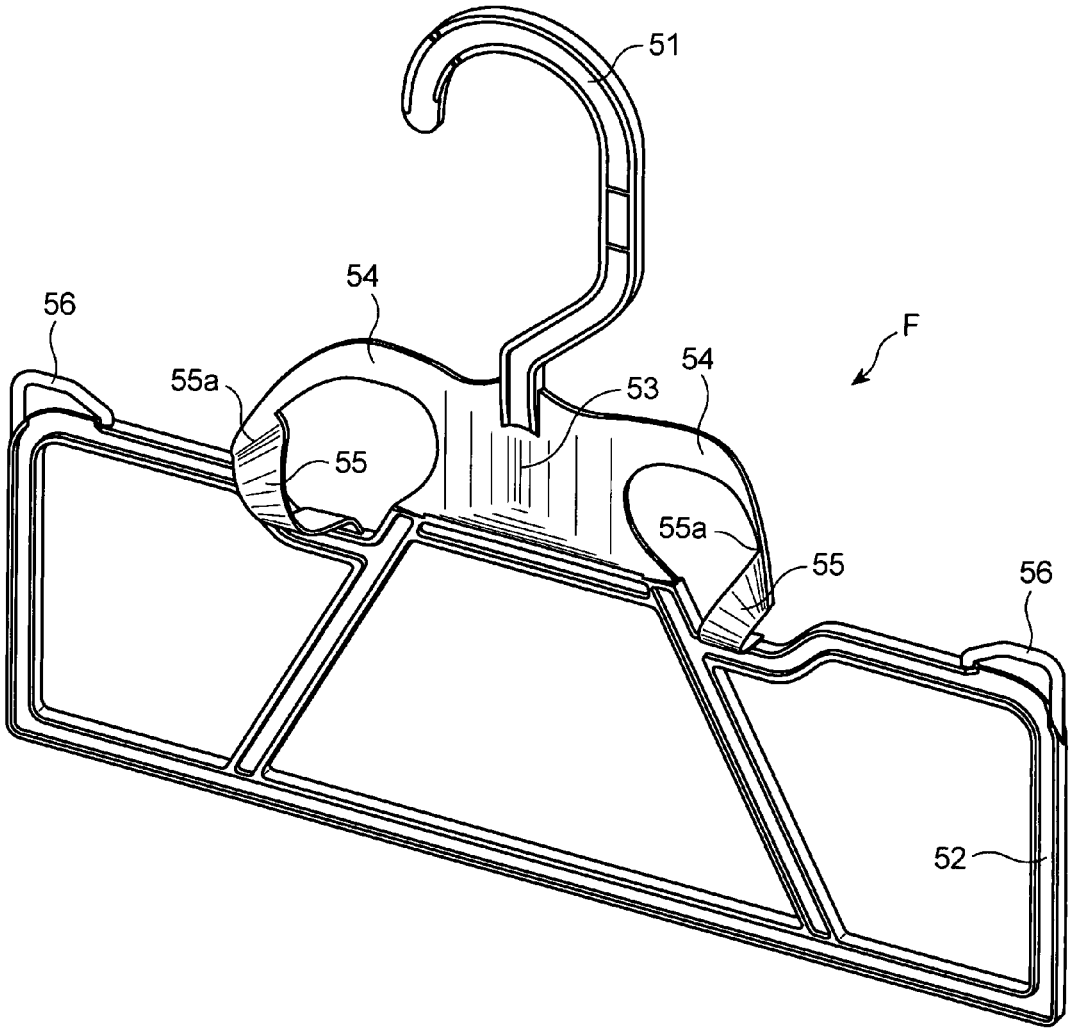
FIG. 18 is a perspective view illustrating a three-dimensional collar shape retaining hanger F according to a seventh embodiment of the present invention.

In FIG. 18, a three-dimensional collar shape retaining hanger F according to the seventh embodiment of the present invention has a hook portion 51 and a hanger body 52. Between the hook portion 51 and the hanger body 52, a connecting plate part 53 (i.e. a connecting portion) which is a central collar supporting portion body is provided to connect the hook portion 51 and the hanger body 52. A pair of first curved parts 54 which protrudes toward a rear side of the hanger F so as to abut on a rear neck portion of a collar is connected to right and left sides of the connecting plate part 53, respectively (i.e. a first curved part formed at the connecting plate portion). To end portions of the first curved parts 54, a pair of second curved parts 55 (i.e. a second curved part having an upper portion connected to a right distal end of the first curved part, and a third curved part having an upper portion connected to a left distal end of the first curved part) is connected at each distal end thereof. Each base end of the second curved parts 55 is connected to the hanger body 52. A portion between the distal end and the base end of each of the second curved parts 55 protrudes toward a front side of the hanger F so as to abut on an inside of a front portion of a collar. The connecting plate part 53 is curved so as to protrude toward the front side of the hanger F. Each upper portion of both ends of the hanger body 52 is provided with a projection 56 for preventing a vertical crease on a front side of a shirt after packaging by pushing up both shoulder portions of the shirt. A whole body of the three-dimensional collar shape retaining hanger F is integrally molded by thermoplastic resin such as polypropylene of the like.

The remaining structures and actions of the sixth embodiment are the same as those of the first embodiment, and the explanation is omitted here.

The first to seventh embodiments of the present invention have been explained above. However, the present invention should not be limited to these embodiments, and the scope of the present invention includes any structure in which a part abutting on an inside of a rear portion of a collar of a garment and a part abutting on an inside of a front portion of a collar protrude toward rear and front sides of a hanger, respectively, and which has a curved collar supporting portion provided with a curved part which abuts on an inside of each side portion of a collar.

What is claimed is:

1. A three-dimensional collar shape retaining hanger comprising:

a hook portion;

a hanger body; and a curved collar supporting portion, wherein said collar supporting portion comprises:

a connecting plate portion connecting said hook portion to said hanger body, said connecting plate portion being disposed in a center of said collar supporting portion between said hook portion and said hanger body, a first curved part formed at said connecting plate portion, said first curved part protruding toward a rear of said three-dimensional collar shape retaining hanger for abutting against an inside rear portion of a collar, a second curved part protruding toward a front of said three-dimensional collar shape retaining hanger for abutting against an inside front portion of the collar, said second curved part having a base portion connected to said hanger body and an upper portion connected to a right distal end of said first curved part, and a third curved part protruding toward the front of said three-dimensional collar shape retaining hanger for abutting against the inside front portion of the collar, said third curved part having a base portion connected to said hanger body and an upper portion connected to a left distal end of said first curved part;

wherein said collar supporting portion has a front face on the front of said three-dimensional collar shape retaining hanger and a rear face on the rear of said three-dimensional collar shape retaining hanger, wherein the hanger body has a front face on the front of said three-dimensional collar shape retaining hanger and a rear face on the rear of said three-dimensional collar shape retaining hanger, and wherein the collar supporting portion is positioned entirely forward of the rear face of the hanger body.

2. The three-dimensional collar shape retaining hanger of claim 1, wherein said first curved part extends from both a left side and a right side of said connecting plate portion.

3. The three-dimensional collar shape retaining hanger of claim 1, wherein said first curved part is formed at a center of said connecting plate portion.

4. The three-dimensional collar shape retaining hanger of claim 1, wherein a right through-hole is disposed in said collar supporting portion, said right through-hole being circumscribed by said second curved part, said first curved part, and said hanger body; and wherein a left through-hole is disposed in said collar supporting portion, said left through-hole being circumscribed by said third curved part, said first curved part, and said hanger body.

5. The three-dimensional collar shape retaining hanger of claim 4, wherein said collar supporting portion is disposed between said hook portion and said hanger body, and wherein said collar supporting portion separates said hook portion from said hanger body.

6. The three-dimensional collar shape retaining hanger of claim 4, wherein said first curved part is formed concavely relative to the front of said three-dimensional collar shape retaining hanger.

7. The three-dimensional collar shape retaining hanger of claim 4, wherein each of said second curved part and said third curved part is formed concavely relative to the rear of said three-dimensional collar shape retaining hanger.

8. The three-dimensional collar shape retaining hanger of claim 4, wherein said first curved part is formed concavely relative to the front of said three-dimensional collar shape retaining hanger; and wherein each of said second curved part and said third curved part is formed concavely relative to the rear of said three-dimensional collar shape retaining hanger.

9. The three-dimensional collar shape retaining hanger of claim 1, wherein said collar supporting portion is disposed between and separates said hook portion and said hanger body.

10. The three-dimensional collar shape retaining hanger of claim 1, wherein said first curved part is formed concavely relative to the front of said three-dimensional collar shape retaining hanger; and wherein each of said second curved part and said third curved part is formed concavely relative to the rear of said three-dimensional collar shape retaining hanger.

11. The three-dimensional collar shape retaining hanger of claim 1, wherein said front face of said collar supporting portion is open so as to conform to a rear face of an identical hanger.

12. The three dimensional collar shape retaining hanger of claim 11, wherein said collar supporting portion is shaped such that said front face of said collar supporting portion conforms to a rear face of an identical hanger, and such that said three dimensional collar shape retaining hanger is configured to be tightly stacked with a plurality of hangers identical to said three dimensional collar shape retaining hanger.

13. The three dimensional collar shape retaining hanger of claim 11, wherein said first curved part protrudes toward the rear of said three dimensional collar shape retaining hanger without doubling-over toward said hanger body, and each of said second curved part and said third curved part protrudes toward the front of said three dimensional collar shape retaining hanger without doubling-over toward said hanger body, such that said front face of said collar supporting portion constitutes an open face operable to conform to a rear face of an identical hanger.

14. The three-dimensional collar shape retaining hanger of claim 1, wherein said collar supporting portion, said hook portion, and said hanger body are integrally molded of thermoplastic resin.

15. The three dimensional collar shape retaining hanger of claim 1, wherein said collar supporting portion is shaped such that said front face of said collar supporting portion conforms to a rear face of an identical hanger, and such that said three dimensional collar shape retaining hanger is configured to be tightly stacked with a plurality of hangers identical to said three dimensional collar shape retaining hanger.

16. The three dimensional collar shape retaining hanger of claim 1, wherein said first curved part protrudes toward the rear of said three dimensional collar shape retaining hanger without doubling-over toward said hanger body, and each of said second curved part and said third curved part protrudes toward the front of said three dimensional collar shape retaining hanger without doubling-over toward said hanger body, such that said front face of said collar supporting portion constitutes an open face operable to conform to a rear face of an identical hanger.

17. The three dimensional collar shape retaining hanger of claim 1, wherein said collar supporting portion and said hanger body are integrally molded together so as to constitute a single molded piece.

* * * * *